US012607186B2

(12) United States Patent
Hashimoto et al.

(10) Patent No.: US 12,607,186 B2
(45) Date of Patent: Apr. 21, 2026

(54) CO-ROTATING SCROLL COMPRESSOR

(71) Applicant: KABUSHIKI KAISHA TOYOTA JIDOSHOKKI, Aichi (JP)

(72) Inventors: Yuji Hashimoto, Aichi (JP); Kazunari Honda, Aichi (JP); Hiroyuki Kobayashi, Aichi (JP); Yosuke Inagaki, Aichi (JP); Akito Sugahara, Aichi (JP); Keishiro Muto, Aichi (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 0 days.

(21) Appl. No.: 18/848,189

(22) PCT Filed: Jan. 24, 2023

(86) PCT No.: PCT/JP2023/002159
§ 371 (c)(1),
(2) Date: Sep. 18, 2024

(87) PCT Pub. No.: WO2023/188746
PCT Pub. Date: Oct. 5, 2023

(65) Prior Publication Data

US 2025/0207588 A1 Jun. 26, 2025

(30) Foreign Application Priority Data

Mar. 31, 2022 (JP) ..... 2022-058149

(51) Int. Cl.
*F04C 18/02* (2006.01)
*F04C 23/00* (2006.01)
(Continued)

(52) U.S. Cl.
CPC ..... *F04C 18/023* (2013.01); *F04C 18/0276* (2013.01); *F04C 29/0021* (2013.01);
(Continued)

(58) Field of Classification Search
CPC ..... F04C 18/023; F04C 18/0276; F04C 29/0021; F04C 18/0261; F04C 23/008;
(Continued)

(56) References Cited

U.S. PATENT DOCUMENTS 4,477,238 A * 10/1984 Terauchi ..... F04C 18/0215 418/5
6,659,745 B2 * 12/2003 Fujita ..... F04C 18/0276 418/55.4
(Continued)

FOREIGN PATENT DOCUMENTS

JP H07-229480 A 8/1995
JP 2002-310073 A 10/2002
(Continued)

OTHER PUBLICATIONS

International Search Report and Written Opinion issued in International Patent Application No. PCT/JP2023/002159, dated Mar. 28, 2023, along with an English translation thereof.

*Primary Examiner* — J. T. Newton
(74) *Attorney, Agent, or Firm* — Greenblum & Bernstein, P.L.C.

(57) ABSTRACT

A co-rotating scroll compressor includes a driving mechanism, a driving scroll, a driven mechanism, a driven scroll, and a housing. The driving scroll is driven rotatably around a driving axis. The driven scroll follows the driving scroll rotatably around a driven axis. The driving scroll has a driving scroll end plate and a driving scroll spiral body. The driven scroll has a driven scroll end plate and a driven scroll spiral body. The driving scroll and the driven scroll form a compression chamber. A driving scroll wall thickness portion is formed on a surface of the driving scroll end plate on which the driving scroll spiral body is formed or a driving scroll spiral short portion is formed in the driving scroll spiral body.

9 Claims, 4 Drawing Sheets

(51) Int. Cl.
*F04C 29/00* (2006.01)
*F04C 29/06* (2006.01)

(52) U.S. Cl.
CPC ..... *F04C 18/0261* (2013.01); *F04C 23/008* (2013.01); *F04C 29/0085* (2013.01); *F04C 29/06* (2013.01)

(58) Field of Classification Search
CPC ... F04C 29/0085; F04C 29/06; F04C 18/0215
See application file for complete search history.

(56) References Cited

U.S. PATENT DOCUMENTS 6,746,224 B2 * 6/2004 Itoh ..... F04C 29/126 418/57
7,344,365 B2 * 3/2008 Takeuchi ..... F04C 28/26 418/57
8,092,199 B2 * 1/2012 Mizuno ..... F04C 18/0215 418/150
8,282,370 B2 * 10/2012 Sato ..... F04C 23/008 418/55.1
9,732,753 B2 * 8/2017 Hirata ..... F04C 18/0215
2002/0150485 A1 10/2002 Mori et al.
2002/0182093 A1 * 12/2002 Fujita ..... F04C 18/0276 418/55.2
2002/0182094 A1 12/2002 Mori et al.

FOREIGN PATENT DOCUMENTS

JP 2002-357188 A 12/2002
JP 5512436 B2 6/2014
WO WO-2008066105 A1 * 6/2008 ..... F04C 18/0215
WO WO-2021054241 A1 * 3/2021 ..... F04C 18/0215

* cited by examiner

CO-ROTATING SCROLL COMPRESSOR

CROSS REFERENCE TO RELATED APPLICATIONS

This application is a National Stage of International Application No. PCT/JP2023/002159 filed Jan. 24, 2023, that claims priority to Japanese Patent Application No. 2022-058149 filed Mar. 31, 2022, both of which are incorporated herein by reference in their entirety including the specification, claims, drawings, and abstract.

TECHNICAL FIELD

The present invention relates to a co-rotating scroll compressor.

BACKGROUND ART

A conventional scroll compressor is disclosed in Patent Document 1. This scroll compressor includes a driving mechanism, a fixed scroll, a driven mechanism, a driven scroll, and a housing.

The driving mechanism has a rotary shaft extending into the housing. The fixed scroll is fixed in the housing. The driven scroll is disposed in the housing and connected to the rotary shaft. The driven scroll is rotatable around a driving axis together with the rotary shaft. While the driven mechanism prevents the driven scroll from rotating, the driven mechanism provides a connection between the driven scroll and the housing.

More specifically, the fixed scroll has a fixed scroll end plate and a fixed scroll spiral body. The fixed scroll end plate extends perpendicular to the driving axis. The fixed scroll spiral body extends in parallel with the driving axis and protrudes from the fixed scroll end plate toward the driven scroll, and the fixed scroll spiral body is formed in a spiral shape around the driving axis.

The driven scroll has a driven scroll end plate and a driven scroll spiral body. The driven scroll end plate extends perpendicular to the driving axis. The driven scroll spiral body extends in parallel with the driving axis and protrudes from the driven scroll end plate toward the fixed scroll, and the driven scroll spiral body is formed in a spiral shape around the driving axis.

In this scroll compressor, the fixed scroll and the driven scroll forms a compression chamber with the fixed scroll spiral body and the driven scroll spiral body facing each other. A volume of the compression chamber is changed as the driven scroll rotates around the driving shaft. As a result, refrigerant gas in a suction chamber is sucked into the compression chamber and compressed. The refrigerant gas compressed in the compression chamber is then discharged to an outside of the scroll compressor.

In addition, in this scroll compressor, a plurality of reduced thickness portions is formed in a surface of the driven scroll end plate opposite a surface on which the driven scroll spiral body is formed. With this configuration, in this scroll compressor, static balance of the driven scroll spiral body is corrected to make a center of gravity of the driven scroll spiral body as close as possible to the driving axis, which reduces noise generated while the driven scroll rotates.

CITATION LIST

Patent Document

Patent Document 1: Japanese Patent No. 5512436

SUMMARY OF DISCLOSURE

Technical Problem

In the above-described conventional scroll compressor, while the plurality of reduced thickness portions formed in the driven scroll spiral body corrects the static balance of the driven scroll spiral body, the reduced thickness portions causes further significant dynamic imbalance of the driven scroll spiral body. Here, in a configuration, as this scroll compressor, in which the fixed scroll is fixed to the housing and only the driven scroll is rotated around the driving axis to compress fluid, the further dynamic imbalance in the driven scroll spiral body does not have a significant effect on quietness.

However, of the scroll compressors, there is a co-rotating scroll compressor in which a driving scroll is driven rotatably around a driving axis and a driven scroll follows the driving scroll rotatably around a driven axis to compress fluid. In order to improve quietness of such a co-rotating scroll compressor, it is necessary not only to correct the static balance but also to suppress the further dynamic imbalance.

The present invention has been made in view of the conventional circumstances described above, and is directed to providing a co-rotating scroll compressor which is superior in quietness.

Solution to Problem

A first co-rotating scroll compressor of the present invention includes a driving mechanism, a driving scroll, a driven mechanism, a driven scroll, and a housing. The driving scroll is driven rotatably around a driving axis by the driving mechanism. The driven scroll follows the driving scroll rotatably around a driven axis that is eccentric to the driving scroll by the driving scroll and the driven mechanism. The driving scroll has a driving scroll end plate that extends perpendicular to the driving axis and a driving scroll spiral body that protrudes from the driving scroll end plate toward the driven scroll and is formed in a spiral shape. The driven scroll has a driven scroll end plate that extends perpendicular to the driven axis and a driven scroll spiral body that protrudes from the driven scroll end plate toward the driving scroll and is formed in a spiral shape. The driving scroll and the driven scroll form a compression chamber with the driving scroll spiral body and the driven scroll spiral body facing each other, the compression chamber changing its volume by the rotational driving of the driving scroll and the rotational following of the driven scroll. A driving scroll wall thickness portion is formed on a surface of the driving scroll end plate on which the driving scroll spiral body is formed or a driving scroll spiral short portion is formed in the driving scroll spiral body, the driving scroll wall thickness portion protruding toward the driven scroll end plate such that a center of gravity of the driving scroll spiral body is made aligned with or close to the driving axis, the driving scroll spiral short portion being shorter than a portion having the longest length in the driving scroll spiral body that extends toward the driven scroll end plate. In a case where the driving scroll wall thickness portion is formed, a driven scroll spiral short portion is formed in the driven scroll spiral body, the driven scroll spiral short portion being shorter than a portion having the longest length in the driven scroll spiral body that extends toward the driving scroll end plate such that the driven scroll spiral short portion allows to the driven scroll spiral body to avoid interference with the driving scroll wall thickness portion. In a case where the driving scroll spiral short portion is formed, a driven scroll wall thickness portion is formed on a surface of the driven scroll end plate on which the driven scroll spiral body is formed, the driven scroll wall thickness portion protruding toward the driving scroll spiral short portion.

In the first co-rotating scroll compressor, the driving scroll wall thickness portion or the driving scroll spiral short portion makes the center of gravity of the driving scroll spiral body aligned with or close to the driving axis.

Here, the driving scroll wall thickness portion is formed in the surface of the driving scroll end plate on which the driving scroll spiral body is formed. With this configuration, in canceling out a centrifugal force that acts on the driving scroll spiral body when the driving scroll is driven rotatably, the centrifugal force is canceled out by the driving scroll wall thickness portion at a position closer to the driving scroll spiral body as compared with a case in which a weight portion is formed on the surface of the driving scroll end plate opposite the surface on which the driving scroll spiral body is formed. Thus, the centrifugal force that acts on the driving scroll spiral body is suitably canceled out by the driving scroll wall thickness portion.

The driving scroll spiral short portion formed in the driving scroll spiral body serves as the reduced thickness portion in the driving scroll spiral body. In other words, the reduced thickness portion is formed in the driving scroll spiral body itself. With this configuration, the centrifugal force is canceled out by the driving scroll spiral short portion at a position closer to the driving scroll spiral body as compared with a case in which the reduced thickness portion is formed in the surface of the driving scroll end plate opposite the driving scroll spiral body is formed. Thus, the centrifugal force that acts on the driving scroll spiral body is suitably canceled out also by the driving scroll spiral short portion.

As described above, in the first co-rotating scroll compressor, further dynamic imbalance of the driving scroll spiral body is suppressed while static balance of the driving scroll spiral body is corrected.

Therefore, the first co-rotating scroll compressor of the present invention is superior in quietness.

A second co-rotating scroll compressor of the present invention includes a driving mechanism, a driving scroll, a driven mechanism, a driven scroll, and a housing. The driving scroll is driven rotatably around a driving axis by the driving mechanism. The driven scroll follows the driving scroll rotatably around a driven axis that is eccentric to the driving scroll by the driving scroll and the driven mechanism. The driving scroll has a driving scroll end plate that extends perpendicular to the driving axis and a driving scroll spiral body that protrudes from the driving scroll end plate toward the driven scroll and is formed in a spiral shape. The driven scroll has a driven scroll end plate that extends perpendicular to the driven axis and a driven scroll spiral body that protrudes from the driven scroll end plate toward the driving scroll and is formed in a spiral shape. The driving scroll and the driven scroll form a compression chamber with the driving scroll spiral body and the driven scroll spiral body facing each other, the compression chamber changing its volume by the rotational driving of the driving scroll and the rotational following of the driven scroll. A driven scroll wall thickness portion is formed on a surface of the driven scroll end plate on which the driven scroll spiral body is formed or a driven scroll spiral short portion is formed in the driven scroll spiral body, the driven scroll wall thickness portion protruding toward the driving scroll end plate such that a center of gravity of the driven scroll spiral body is made aligned with or close to the driven axis, the driven scroll spiral short portion being shorter than a portion having the longest length in the driven scroll spiral body that extends toward the driving scroll end plate. In a case where the driven scroll wall thickness portion is formed, a driving scroll spiral short portion is formed in the driving scroll spiral body, the driving scroll spiral short portion being shorter than a portion having the longest length in the driving scroll spiral body that extends toward the driven scroll end plate such that the driving scroll spiral short portion allows the driving scroll spiral body to avoid interference with the driven scroll wall thickness portion. In a case where the driven scroll spiral short portion is formed, a driving scroll wall thickness portion is formed on a surface of the driving scroll end plate on which the driving scroll spiral body is formed, the driving scroll wall thickness portion protruding toward the driven scroll spiral short portion.

In the second co-rotating scroll compressor, the driven scroll wall thickness portion or the driven scroll spiral short portion makes the center of gravity of the driven scroll spiral body aligned with or close to the driven axis.

Here, the driven scroll wall thickness portion is formed in the surface of the driven scroll end plate on which the driven scroll spiral body is formed. The driven scroll spiral short portion formed in the driven scroll spiral body serves as the reduced thickness portion in the driven scroll spiral body. Accordingly, a centrifugal force that acts on the driven scroll spiral body when the driven scroll follows the driving scroll rotatably is suitably canceled out by the driven scroll wall thickness portion and the driven scroll spiral short portion. As described above, in the second co-rotating scroll compressor, further dynamic imbalance of the driven scroll spiral body is suppressed while static balance of the driven scroll spiral body is corrected.

Therefore, the second co-rotating scroll compressor of the present invention is superior in quietness.

A third co-rotating scroll compressor of the present invention includes a driving mechanism, a driving scroll, a driven mechanism, a driven scroll, and a housing. The driving scroll is driven rotatably around a driving axis by the driving mechanism. The driven scroll follows the driving scroll rotatably around a driven axis that is eccentric to the driving scroll by the driving scroll and the driven mechanism. The driving scroll has a driving scroll end plate that extends perpendicular to the driving axis and a driving scroll spiral body that protrudes from the driving scroll end plate toward the driven scroll and is formed in a spiral shape. The driven scroll has a driven scroll end plate that extends perpendicular to the driven axis and a driven scroll spiral body that protrudes from the driven scroll end plate toward the driving scroll and is formed in a spiral shape. The driving scroll and the driven scroll form a compression chamber with the driving scroll spiral body and the driven scroll spiral body facing each other, the compression chamber changing its volume by the rotational driving of the driving scroll and the rotational following of the driven scroll. A driving scroll wall thickness portion protruding toward the driven scroll spiral body is formed in the driving scroll end plate. A driven scroll wall thickness portion protruding toward the driving scroll spiral body is formed in the driven scroll end plate. A driving scroll spiral short portion is formed in the driving scroll spiral body, the driving scroll spiral short portion being shorter than a portion having the longest length in the driving scroll spiral body that extends toward the driven scroll end plate such that the driving scroll spiral short portion allows the driving scroll spiral body to avoid interference with the driven scroll wall thickness portion. A driven scroll spiral short portion is formed in the driven scroll spiral body, the driven scroll spiral short portion being shorter than a portion having the longest length in the driven scroll spiral body that extends toward driving scroll end plate such that the driven scroll spiral short portion allows the driven scroll spiral body to avoid interference with the driving scroll wall thickness portion. The driving scroll wall thickness portion and the driving scroll spiral short portion are disposed such that a center of gravity of the driving scroll spiral body is made aligned with or close to the driving axis. The driven scroll wall thickness portion and the driven scroll spiral short portion are disposed such that a center of gravity of the driven scroll spiral body is made aligned with or close to the driven axis.

In the third co-rotating scroll compressor of the present invention, the driving scroll wall thickness portion and the driving scroll spiral short portion make the center of gravity of the driving scroll spiral body aligned with or close to the driving axis, and the driven scroll wall thickness portion and the driven scroll spiral short portion make the center of gravity of the driven scroll spiral body aligned with or close to the driven axis.

Then, the centrifugal force that acts on the driving scroll spiral body is suitably canceled out by the driving scroll wall thickness portion and the driving scroll spiral short portion, and the centrifugal force that acts on the driven scroll spiral body is suitably canceled out by the driven scroll wall thickness portion and the driven scroll spiral short portion. Thus, further dynamic imbalance of the driving scroll spiral body and the driven scroll spiral body is suppressed while static balance of the driving scroll spiral body and the driven scroll spiral body is corrected.

Therefore, the third co-rotating scroll compressor of the present invention is superior in quietness.

In the first to third co-rotating scroll compressors of the present invention, a weight body or a reduced thickness portion is preferably provided such that the center of gravity of the driving scroll spiral body is made aligned with or close to the driving axis, on a surface of the driving scroll end plate opposite the surface on which the driving scroll spiral body is formed. In this case, the static balance of the driving scroll spiral body is adjusted also by the weight body or the reduced thickness portion.

In the first to third co-rotating scroll compressors of the present invention, a weight body or a reduced thickness portion is preferably provided such that the center of gravity of the driven scroll spiral body is made aligned with or close to the driven axis, on a surface of the driven scroll end plate opposite the surface on which the driven scroll spiral body is formed. In this case, the static balance of the driven scroll spiral body is adjusted also by the weight body or the reduced thickness portion.

Advantageous Effects of Disclosure

The first to third co-rotating scroll compressors of the present invention are superior in quietness.

DESCRIPTION OF EMBODIMENTS

The following will describe an embodiment of the present invention with reference to the drawings.

Figure 1:
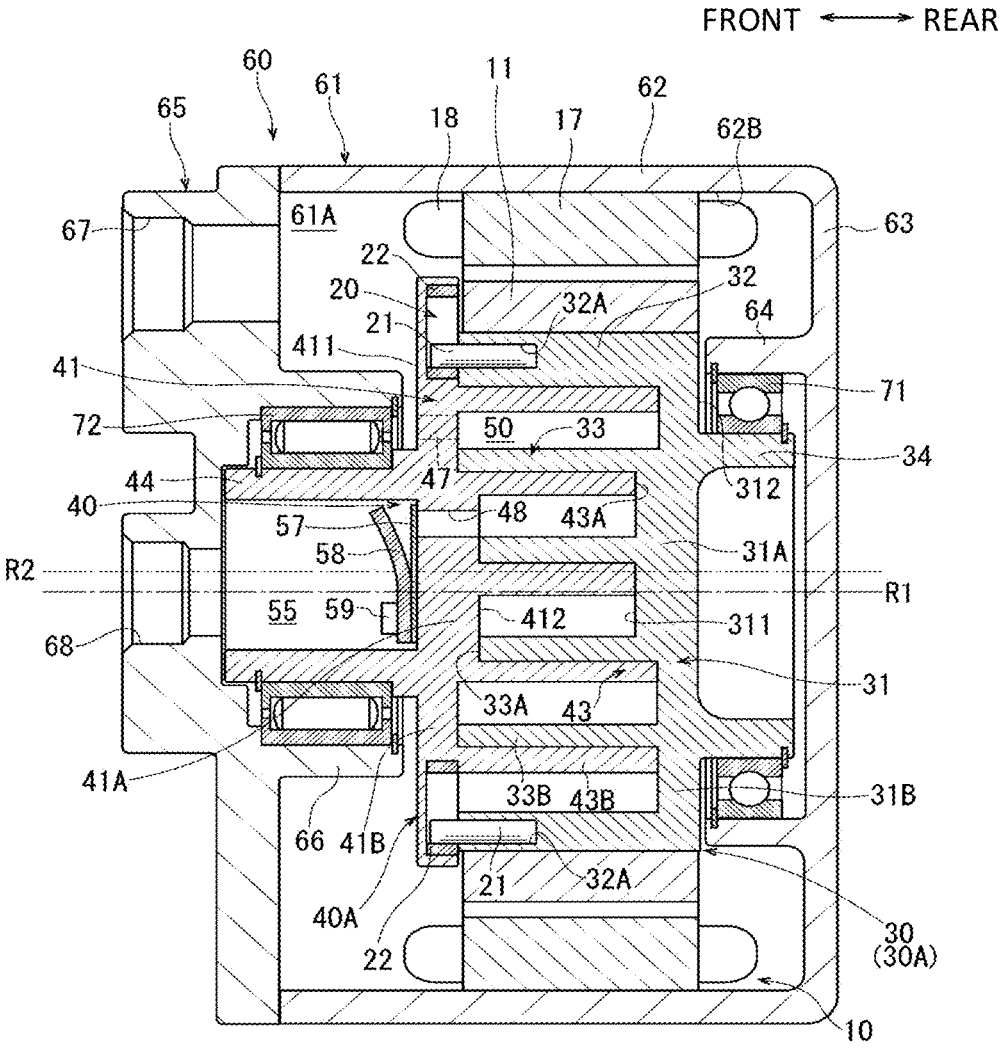
FIG. 1 is a longitudinal sectional view of a co-rotating scroll compressor according to an embodiment.

As illustrated in FIG. 1, a co-rotating scroll compressor (hereinafter, simply referred to as the compressor) of the embodiment includes a housing 60, an electric motor 10, a driving scroll 30, a driven scroll 40, and a driven mechanism 20. The electric motor 10 is an example of the "driving mechanism" in the present invention. This compressor is mounted on a vehicle, which is not illustrated, and is a part of an air conditioner for the vehicle.

In the present embodiment, a front-rear direction of the compressor is defined by a solid arrow illustrated in FIG. 1. Note that the front-rear direction is an example for convenience of explanation, and a posture of the compressor may be changed as appropriate according to the vehicle on which the compressor is mounted.

The housing 60 is formed of a housing main body 61 and a cover 65. The housing main body 61 is a bottomed cylindrical member having an outer peripheral wall 62 and a bottom wall 63. The outer peripheral wall 62 has a cylindrical shape extending around a driving axis R1. The driving axis R1 is parallel with the front-rear direction. The outer peripheral wall 62 also has an inner peripheral surface 62B. The bottom wall 63 is located at a rear end of the housing main body 61. The bottom wall 63 is formed in a substantially circular plate shape extending perpendicular to the driving axis R1.

An outer peripheral edge of the bottom wall 63 is connected to a rear end of the outer peripheral wall 62. The bottom wall 63 has a shaft support portion 64 that protrudes from an inner surface of the bottom wall 63 at a center thereof and has a cylindrical shape extending around the driving axis R1. An outer ring of a bearing 71 is fitted in the shaft support portion 64.

The cover 65 is disposed in front of the housing main body 61. The cover 65 is formed in a substantially circular plate shape extending perpendicular to the driving axis R1. The cover 65 is fastened to the outer peripheral wall 62 by bolts, which are not illustrated, with an outer peripheral edge of the cover 65 in contact with a front end of the outer peripheral wall 62 of the housing main body 61. With this configuration, the cover 65 covers the housing main body 61 at the front thereof. Thus, a suction chamber 61A is formed in the housing main body 61.

The cover 65 has a shaft support portion 66 that protrudes from an inner surface of the cover 65 at a center thereof and has a cylindrical shape extending around a driven axis R2. The driven axis R2 is eccentric to the driving axis R1 and extends in parallel with the driving axis R1. That is, the driven axis R2 is also parallel with the front-rear direction. An outer ring of a needle bearing 72 is fitted in the shaft support portion 66.

The cover 65 has a suction communication port 67 and a discharge communication port 68. The suction communication port 67 is located between an outer peripheral edge of the cover 65 and the shaft support portion 66, and extends in parallel with driving axis R1 through the cover 65. The suction chamber 61A communicates with an outside of the compressor through the suction communication port 67. A tube is connected to the suction communication port 67. Refrigerant gas at low temperature and low pressure after flowing through an evaporator is sucked into the suction chamber 61A through the tube.

The discharge communication port 68 is located at a center of the cover 65 and extends in parallel with the driving axis R1 through the cover 65. The discharge communication port 68 communicates with a discharge chamber 55, 20) which will be described later. A tube is connected to the discharge communication port 68, and the refrigerant gas discharged into the discharge chamber 55 flows to a condenser through the tube. Note that illustrations of the tubes, the evaporator, and the condenser are omitted.

The electric motor 10 is accommodated in the suction chamber 61A. That is, the suction chamber 61A also serves as a motor chamber in which the electric motor 10 is accommodated. The electric motor 10 is formed of a stator 17 and a rotor 11.

The stator 17 is formed in a cylindrical shape extending around the driving axis R1 and has a winding wire 18. The stator 17 is fitted into the inner peripheral surface 62B of the outer peripheral wall 62 of the housing main body 61, so that the stator 17 is fixed in the housing main body 61 and, by extension, in the housing 60.

The rotor 11 is formed in a cylindrical shape extending around the driving axis R1 and disposed in the stator 17. Although a detailed illustration is omitted, the rotor 11 is formed of a plurality of permanent magnets corresponding to the stator 17 and a laminated steel plates for fixing the permanent magnets.

The driving scroll 30 is formed of only a driving scroll main body 30A made of aluminum alloy. The driving scroll main body 30A is formed by casting. The driving scroll main body 30A, that is, the driving scroll 30, has a driving scroll end plate 31, a driving scroll peripheral wall 32, and a driving scroll spiral body 33.

The driving scroll end plate 31 is formed in a substantially circular plate shape extending perpendicular to the driving axis R1. The driving scroll end plate 31 has a front surface 311 and a rear surface 312 located opposite the front surface 311. A first boss 34 that protrudes toward the bottom wall 63 is formed at a center of the rear surface 312. The first boss 34 has a cylindrical shape extending around the driving axis R1.

Figure 2:
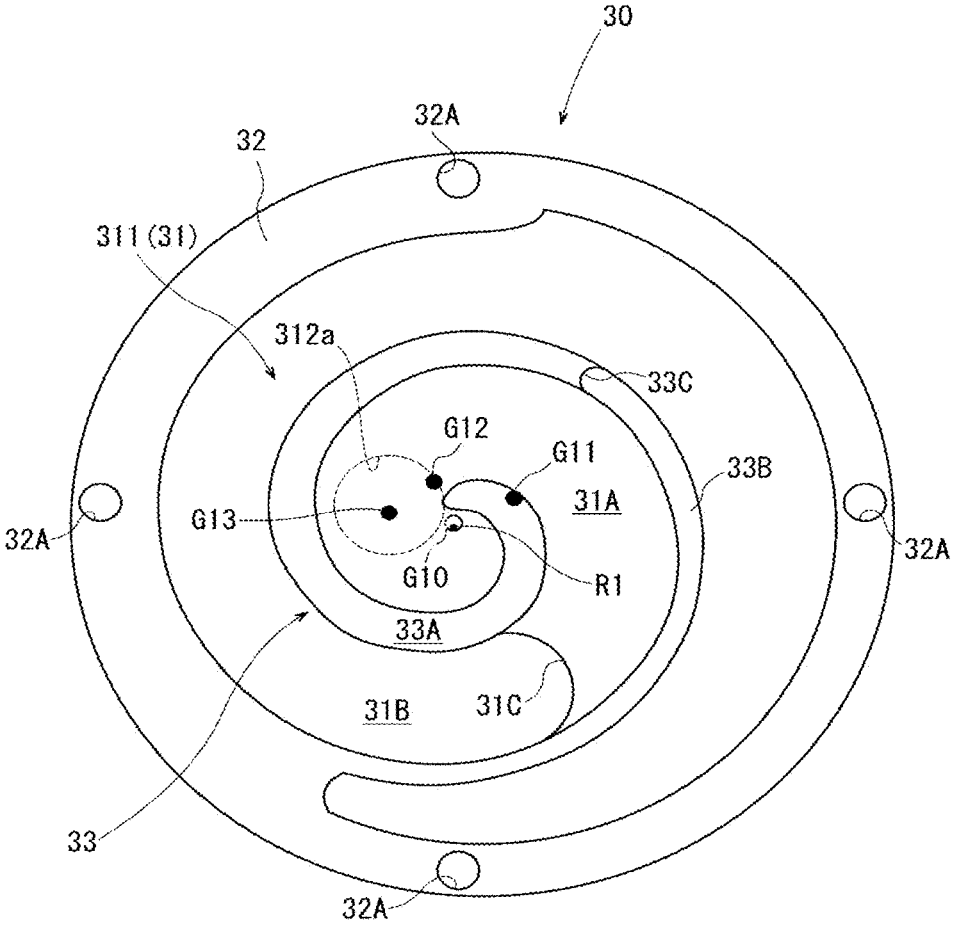
FIG. 2 is a front view of a driving scroll according to the co-rotating scroll compressor of the embodiment.

The driving scroll peripheral wall 32 is integrally formed with the driving scroll end plate 31 and extends in parallel with the driving axis R1 from an outer peripheral edge of the driving scroll end plate 31 forward, that is, toward the driven scroll 40. As illustrated in FIG. 2, the driving scroll peripheral wall 32 is formed in a substantially cylindrical shape extending around the driving axis R1. Four fixing holes 32A are formed in a front end of the driving scroll peripheral wall 32.

The driving scroll spiral body 33 is located inside the driving scroll peripheral wall 32. As illustrated in FIG. 1, the driving scroll spiral body 33 extends in parallel with the driving axis R1 from the front surface 311 of the driving scroll end plate 31 forward, that is, toward the driven scroll 40. As illustrated in FIG. 2, the driving scroll spiral body 33 is formed in a spiral shape around the driving axis R1. More specifically, the driving scroll spiral body 33 is formed so as to extend spirally clockwise around the driving axis R1 from a center of the spiral.

Thus, since the driving scroll spiral body 33 extends from the front surface 311, the front surface 311 corresponds to the "surface of the driving scroll end plate on which the driving scroll spiral body is formed" in the present invention. On the other hand, the rear surface 312 corresponds to the "surface of the driving scroll end plate opposite the surface on which the driving scroll spiral body is formed" in the present invention.

As illustrated in FIG. 1, the driven scroll 40 has a driven scroll main body 40A made of aluminum alloy, a discharge reed valve 57 made of steel, a retainer 58 made of steel, and a fixing pin 59 made of steel. Each of the discharge reed valve 57, the retainer 58, and the fixing pin 59 is an example of the "weight body" in the present invention.

Similarly to the driving scroll main body 30A, the driven scroll main body 40A is also formed by casting. The driven scroll main body 40A has a driven scroll end plate 41 and a driven scroll spiral body 43. The driven scroll end plate 41 is formed in a substantially circular plate shape extending perpendicular to the driven axis R2. The driven scroll end plate 41 has a front surface 411 and a rear surface 412 located opposite the front surface 411. A second boss 44 that protrudes toward the cover 65 is formed at a center of the front surface 411. The second boss 44 has a cylindrical shape extending around the driven axis R2.

The driven scroll end plate 41 has a suction port 47 and a discharge port 48. The suction port 47 is formed outside the second boss 44 in the driven scroll end plate 41 and extends in the front-rear direction through the driven scroll end plate 41. The discharge port 48 is formed inside the second boss 44 in the driven scroll end plate 41 and extends in the front-rear direction through the driven scroll end plate 41.

In addition, in the second boss 44, the discharge reed valve 57 and the retainer 58 are fixed to the front surface 411 of the driven scroll end plate 41 by the fixing pin 59. This allows the discharge reed valve 57 to open or close the discharge port 48, and a degree of opening of the discharge reed valve 57 is adjustable by the retainer 58. Here, the discharge reed valve 57, the retainer 58, and the fixing pin 59 are made of steel, and specific gravity of steel is larger than that of aluminum alloy, which is a material of the driven scroll main body 40A.

Figure 3:
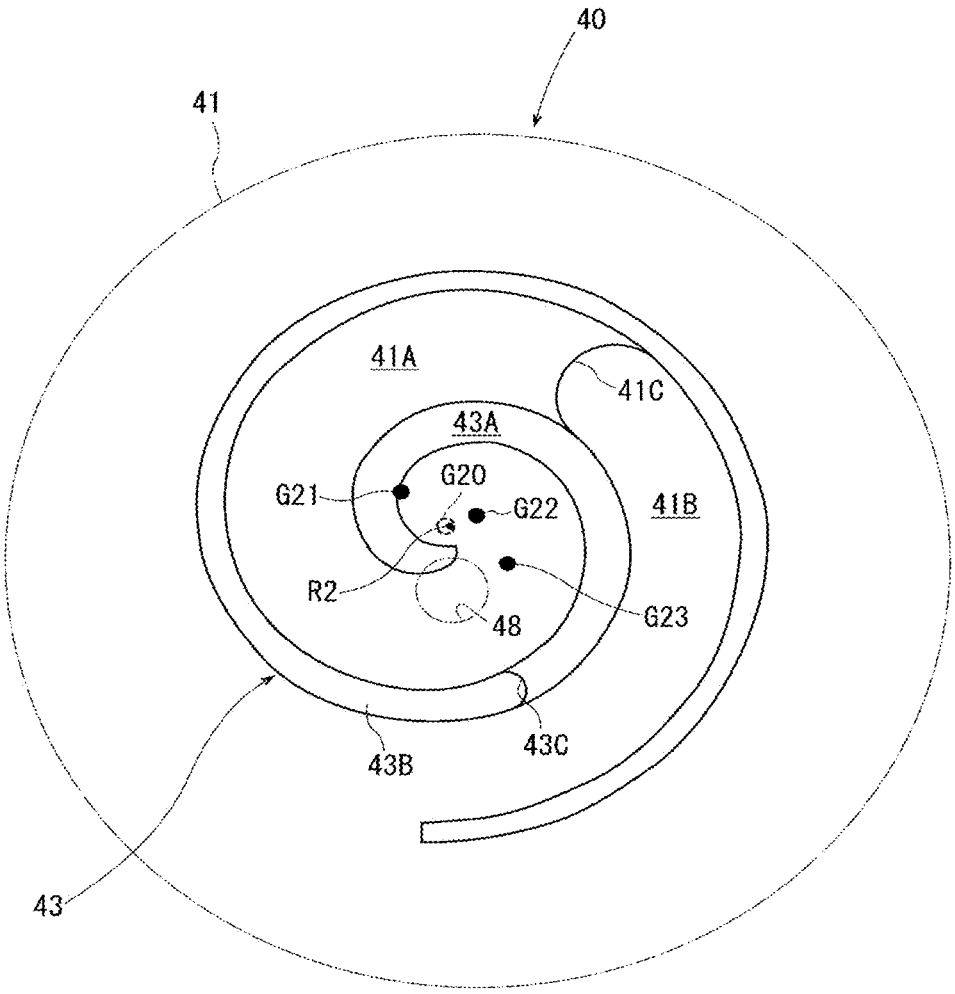
FIG. 3 is a front view of a driven scroll according to the co-rotating scroll compressor of the embodiment.

The driven scroll spiral body 43 extends in parallel with the driven axis R2 from the rear surface 412 of the driven scroll end plate 41 rearward, that is, toward the driving scroll 30. As illustrated in FIG. 3, the driven scroll spiral body 43 is formed in a spiral shape around the driven axis R2. More specifically, the driven scroll spiral body 43 is formed to extend spirally clockwise around the driven axis R2 from a center of the spiral.

Thus, since the driven scroll spiral body 43 extends from the rear surface 412. the rear surface 412 corresponds to the "surface of the driven scroll end plate on which the driven scroll spiral body is formed" in the present invention. On the other hand, the front surface 411 corresponds to the "surface of the driven scroll end plate opposite the surface on which the driven scroll spiral body is formed" in the present invention. Note that an outer shape of the driven scroll end plate 41 is illustrated in a simple manner in FIG. 3. In addition, in FIG. 3 and FIG. 4, which will be described later, an illustration of the suction port 47 is omitted.

As illustrated in FIG. 1, the driven mechanism 20 is formed of four anti-rotation pins 21 and four rings 22. Note that the number of the anti-rotation pins 21 and the number of the rings 22 may be designed as appropriate as long as each of them is three or more. In addition, in FIG. 1, two of the anti-rotation pins 21 and two of the rings 22 are illustrated.

The anti-rotation pins 21 are inserted into and fixed to the fixing holes 32A formed in the driving scroll peripheral wall 32. Thus, the anti-rotation pins 21 are fixed to the driving scroll peripheral wall 32 such that the anti-rotation pins 21 protrude forward from the driving scroll peripheral wall 32.

The rings 22 are formed in the driven scroll end plate 41 so as to face the anti-rotation pins 21. The rings 22 are fitted into bottomed circular holes which are recesses formed in the rear surface 412 of the driven scroll end plate 41.

In this compressor, the driving scroll 30 and the driven scroll 40 are both disposed in the suction chamber 61A. The driving scroll peripheral wall 32 is fixed to an inner peripheral surface of the rotor 11, so that the driving scroll 30 is integrated with the rotor 11. In addition, the first boss 34 of the driving scroll 30 is fitted into an inner ring of the bearing 71. With this configuration, the driving scroll 30 is supported rotatably around the driving axis R1 by the housing main body 61. Here, in this compressor, the driving scroll 30 is supported so-called at only one end of the driving scroll 30 by the housing main body 61 and, by extension, the housing 60.

On the other hand, the driven scroll 40 is disposed in front of the driving scroll 30 such that the driven scroll spiral body 43 faces the driving scroll 30. With this configuration, the front surface 311 of the driving scroll end plate 31 faces the rear surface 412 of the driven scroll end plate 41 in a direction in which the driving axis R1 extends and in a direction in which the driven axis R2 extends. Then, in the driving scroll 30 and the driven scroll 40, the driving scroll spiral body 33 and the driven scroll spiral body 43 is engaged with each other inside the driving scroll peripheral wall 32, and the anti-rotation pins 21 are inserted into the rings 22. Thus, the driving scroll 30 and the driven scroll 40 are assembled to each other in the front-rear direction. The driving scroll spiral body 33 and the driven scroll spiral body 43 form a compression chamber 50 therebetween.

In the driven scroll 40, the second boss 44 is fitted in an inner ring of the needle bearing 72. With this configuration, the driven scroll 40 is supported rotatably around the driven axis R2 by the cover 65. Here, in this compressor, the driven scroll 40 is also supported so-called at only one end of the driven scroll 40 by the cover 65 and, by extension, the housing 60.

The driven scroll 40 is supported by the cover 65, which forms a space as the discharge chamber 55, the space being surrounded by an inner peripheral surface of the second boss 44 and interposed between the cover 65 and the driven scroll end plate 41. That is, the discharge reed valve 57, the retainer 58, and the fixing pin 59 are disposed in the discharge chamber 55. Accordingly, the discharge reed valve 57, the retainer 58, and the fixing pin 59 are located near the driven axis R2.

In addition, in this compressor, a driving scroll wall thickness portion 31A is formed in the driving scroll end plate 31 of the driving scroll 30, and a driving scroll spiral short portion 33A is formed in the driving scroll spiral body 33. Furthermore, a driven scroll wall thickness portion 41A is formed in the driven scroll end plate 41 of the driven scroll 40, and a driven scroll spiral short portion 43A is formed in the driven scroll spiral body 43.

As illustrated in FIG. 2, the driving scroll wall thickness portion 31A is formed in the front surface 311 of the driving scroll end plate 31. The driving scroll wall thickness portion 31A extends spirally clockwise from a center portion of the front surface 311, that is, a portion of the front surface 311 close to the driving axis R1 and close to the center of the spiral of the driving scroll spiral body 33 toward an outer periphery of the front surface 311 along the driving scroll spiral body 33. As illustrated in FIG. 1, the driving scroll wall thickness portion 31A protrudes from a portion of the driving scroll end plate 31 excluding the driving scroll wall thickness portion 31A (hereinafter, referred to as a driving scroll end plate main body portion 31B) toward the driven scroll spiral body 43. That is, the driving scroll wall thickness portion 31A is formed to be thicker than the driving scroll end plate main body portion 31B.

As illustrated in FIG. 2, a first step portion 31C is formed at a boundary between the driving scroll wall thickness portion 31A and the driving scroll end plate main body portion 31B. A length of the driving scroll wall thickness portion 31A that extends toward the outer periphery of the front surface 311, that is, a position where the first step portion 31C is formed may be designed as appropriate.

On the other hand, as illustrated in FIG. 1, the driven scroll wall thickness portion 41A is formed in the rear surface 412 of the driven scroll end plate 41. As illustrated in FIG. 3, the driven scroll wall thickness portion 41A extends spirally clockwise from a center portion of the rear surface 412, that is, a portion of the rear surface 412 close to the driven axis R2 and close to the center of the spiral of the driven scroll spiral body 43 toward an outer periphery of the rear surface 412 along the driven scroll spiral body 43. As illustrated in FIG. 1, the driven scroll wall thickness portion 41A protrudes from a portion of the driven scroll end plate 41 excluding the driven scroll wall thickness portion 41A (hereinafter, referred to as a driven scroll end plate main body portion 41B) toward the driving scroll spiral body 33. That is, the driven scroll wall thickness portion 41A is formed to be thicker than the driving scroll end plate main body portion 41B.

In addition, as illustrated in FIG. 3, a second step portion 41C is formed at a boundary between the driven scroll wall thickness portion 41A and the driving scroll end plate main body portion 41B. A length of the driven scroll wall thickness portion 41A that extends toward the outer periphery of the rear surface 412, that is, a position where the second step portion 41C is formed may be designed as appropriate.

The discharge port 48 is open in the driven scroll wall thickness portion 41A. Furthermore, as illustrated in FIG. 1, the driven scroll wall thickness portion 41A, the discharge reed valve 57, the retainer 58, and the fixing pin 59 are overlapped in the front-rear direction, that is, in the direction in which the driven axis R2 extends.

Figure 4:
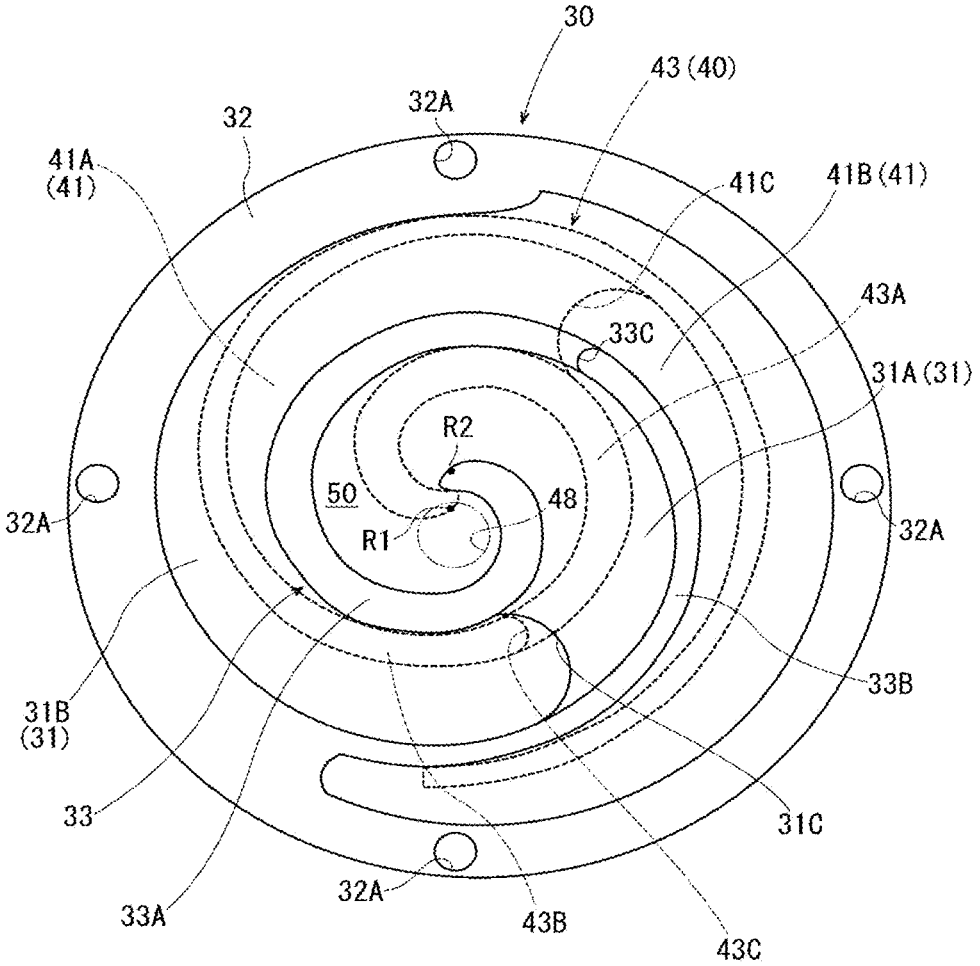
FIG. 4 is a front view of the driving scroll and the driven scroll according to the co-rotating scroll compressor according to the embodiment.

As illustrated in FIG. 2, the driving scroll spiral short portion 33A extends from the center of the spiral of the driving scroll spiral body 33 toward the outer periphery of the spiral. As illustrated in FIGS. 1 and 4, when the driving scroll 30 is assembled to the driven scroll 40 in the front-rear direction, the driving scroll spiral short portion 33A faces the driven scroll wall thickness portion 41A. Here, as illustrated in FIG. 1, a length of the driving scroll spiral short portion 33A that extends toward the driven scroll end plate 41, that is, a length of the driving scroll spiral short portion 33A in the direction in which the driving axis R1 extends, is shorter than a length of a portion of the driving scroll spiral body 33 excluding the driving scroll spiral short portion 33A (hereinafter, referred to as a driving scroll spiral main body portion 33B) in the direction in which the driving axis R1 extends.

In other words, the driving scroll spiral main body portion 33B is a portion having the longest length in the driving scroll spiral body 33 that extends toward the driven scroll end plate 41. Accordingly, the driving scroll spiral short portion 33A is located at a recessed position, in the direction in which the driving axis R1 extends, from the portion having the longest length in the driving scroll spiral body 33 that extends toward the driven scroll end plate 41. With this configuration, the driving scroll spiral short portion 33A allows the driving scroll spiral body 33 to avoid interference with the driven scroll wall thickness portion 41A.

As illustrated in FIG. 2, a third step portion 33C is formed at a boundary between the driving scroll spiral short portion 33A and the driving scroll spiral main body portion 33B.

As illustrated in FIG. 3, the driven scroll spiral short portion 43A extends from the center of the spiral of the driven scroll spiral body 43 toward the outer periphery of the spiral. As illustrated in FIGS. 1 and 4, when the driving scroll 30 is assembled to the driven scroll 40 in the front-rear direction, the driven scroll spiral short portion 43A faces the driving scroll wall thickness portion 31A. Here, as illustrated in FIG. 1, a length of the driven scroll spiral short portion 43A that extends toward the driving scroll end plate 31, that is, a length of the driven scroll spiral short portion 43A in the direction in which the driven axis R2 extends is shorter than a length of a portion of the driven scroll spiral body 43 excluding the driven scroll spiral short portion 43A (hereinafter, referred to as a driven scroll spiral main body portion 43B) in the direction in which the driven axis R2 extends.

In other words, the driven scroll spiral main body portion 43B is a portion having the longest length in the driven scroll spiral body 43 that extends toward the driving scroll end plate 31. Accordingly, the driven scroll spiral short portion 43A is located at a recessed position, in the direction in which the driven axis R2 extends, from the portion having the longest length in the driven scroll spiral body 43 that extends toward the driving scroll end plate 31. With this configuration, the driven scroll spiral short portion 43A allows the driven scroll spiral body 43 to avoid interference with the driving scroll wall thickness portion 31A.

In addition, as illustrated in FIG. 3, a fourth step portion 43C is formed at a boundary between the driven scroll spiral short portion 43A and the driven scroll spiral main body portion 43B.

Thus, the driving scroll wall thickness portion 31A is formed in the driving scroll end plate 31 and the driving scroll spiral short portion 33A is formed in the driving scroll spiral body 33, so that in the driving scroll 30, a center of gravity G11 of the driving scroll wall thickness portion 31A and a center of gravity G12 of the driving scroll spiral short portion 33A are approximately located at positions indicated by black circles in FIG. 2. In addition, when the driving scroll wall thickness portion 31A is not formed in the driving scroll end plate 31 and the driving scroll spiral short portion 33A is not formed in the driving scroll spiral body 33, a center of gravity of the driving scroll spiral body 33 (hereinafter, referred to as an imaginary center of gravity G13) is approximately located at a position indicated by a black circle in FIG. 2.

A recess 312*a* is formed in the rear surface 312 of the driving scroll end plate 31. The recess 312*a* is an example of the "reduced thickness portion" in the present invention. The recess 312*a* is formed in a substantially cylindrical shape extending from the rear surface 312 forward such that the recess 312*a* is overlapped with the imaginary center of gravity G13 indicated by the black circle. Note that an illustration of the recess 312*a* is omitted in FIGS. 1 and 4. The number of the recesses 312*a* and a shape thereof may be designed as appropriate.

The driven scroll wall thickness portion 41A is formed in the driven scroll end plate 41 and the driven scroll spiral short portion 43A is formed in the driven scroll spiral body 43, so that in the driven scroll 40, a center of gravity G21 of the driven scroll wall thickness portion 41A and a center of gravity G22 of the driven scroll spiral short portion 43A are approximately located at the positions indicated by black circles in FIG. 3. When the driven scroll wall thickness portion 41A is not formed in the driven scroll end plate 41 and the driven scroll spiral short portion 43A is not formed in the driven scroll spiral body 43, a center of gravity of the driven scroll spiral body 43 (hereinafter, referred to as an imaginary center of gravity G23) is approximately located at a position indicated by a black circle in FIG. 3.

In this compressor that has the above-described configuration, when the electric motor 10 is operated to rotate the rotor 11, the driving scroll 30 is driven rotatably around the driving axis R1 in the suction chamber 61A. That is, the driving scroll 30 rotates integrally with the rotor 11. Here, in the driven mechanism 20, while each of the anti-rotation pins 21 slides on an inner peripheral surface of the corresponding ring 22, the ring 22 is rotated relative to the anti-rotation pin 21 around the anti-rotation pin 21. Thus, the driven mechanism 20 transfers torque of the driving scroll 30 to the driven scroll 40.

As a result, the driven scroll 40 follows the driving scroll 30 rotatably around the driven axis R2 by the driving scroll 30 and the driven mechanism 20. Here, the driven mechanism 20 prevents the driven scroll 40 from rotating. With this configuration, the driven scroll 40 orbits around the driving axis R1 relative to the driving scroll 30 by the rotational driving of the driving scroll 30 and the rotational following of the driven scroll 40, which changes a volume of the compression chamber 50.

Thus, the refrigerant gas in the suction chamber 61A is sucked into the compression chamber 50 through the suction port 47, and then, compressed in the compression chamber 50. The refrigerant gas that is compressed in the compression chamber 50 to reach a discharge pressure is discharged into the discharge chamber 55 through the discharge port 48, and further discharged into the condenser through the discharge communication port 68. In this manner, air conditioning is performed by the air conditioner for the vehicle.

In this compressor, the driving scroll wall thickness portion 31A is formed in the driving scroll end plate 31 of the driving scroll 30 and the driving scroll spiral short portion 33A is formed in the driving scroll spiral body 33. Furthermore, the driven scroll wall thickness portion 41A is formed in the driven scroll end plate 41 of the driven scroll 40 and the driven scroll spiral short portion 43A is formed in the driven scroll spiral body 43.

Then, the center of gravity G11 of the driving scroll wall thickness portion 31A, the center of gravity G12 of the driving scroll spiral short portion 33A, and the imaginary center of gravity G13 of the driving scroll spiral body 33 are located at the positions illustrated in FIG. 2. Accordingly, in the driving scroll 30, a center of gravity G10 of the driving scroll spiral body 33 is located at a substantially middle position of the center of gravity G11, the center of gravity G12, and the imaginary center of gravity G13, as illustrated by a dashed and double dotted line in FIG. 2. Thus, in this compressor, it is possible to make the center of gravity G10 of the driving scroll spiral body 33 substantially aligned with the driving axis R1.

In addition, the center of gravity G21 of the driven scroll wall thickness portion 41A, the center of gravity G22 of the driven scroll spiral short portion 43A, and the imaginary center of gravity G23 of the driven scroll spiral body 43 are located at the positions illustrated in FIG. 3. Accordingly, as illustrated by a broken line in FIG. 3, in the driven scroll 40, a center of gravity G20 of the driven scroll spiral body 43 is located at a substantially middle position of the center of gravity G21, the center of gravity G22, and the imaginary center of gravity G23. Thus, in this compressor, it is possible to make the center of gravity G20 of the driven scroll spiral body 43 substantially aligned with the driven axis R2.

Here, the wording of "make the center of gravity G10 of the driving scroll spiral body 33 substantially aligned with the driving axis R1" means not only a case where the center of gravity G10 of the driving scroll spiral body 33 is made completely aligned with the driving axis R1 but also a case where although the center of gravity G10 is not completely aligned with the driving axis R1, the center of gravity G10 of the driving scroll spiral body 33 is made close to the driving axis R1. In addition, the wording of "make the center of gravity G20 of the driven scroll spiral body 43 substantially aligned with the driven axis R2" means not only a case where the center of gravity G20 of the driven scroll spiral body 43 is made completely aligned with the driven axis R2 but also a case where although the center of gravity G20 is not completely aligned with the driven axis R2, the center of gravity G20 of the driven scroll spiral body 43 is made close the driven axis R2.

The driving scroll wall thickness portion 31A is formed in the front surface 311 of the driving scroll end plate 31 and located close to the driving scroll spiral body 33. The driving scroll spiral short portion 33A formed in the driving scroll spiral body 33 serves as the reduced thickness portion in the driving scroll spiral body 33. As described above, the center of gravity G11 of the driving scroll wall thickness portion 31A and the center of gravity G12 of the driving scroll spiral short portion 33A are located at the positions illustrated in FIG. 2. Accordingly, a centrifugal force that acts on the driving scroll spiral body 33 when the driving scroll 30 is driven rotatably is canceled out at a position close to the driving scroll spiral body 33 by the driving scroll wall thickness portion 31A and the driving scroll spiral short portion 33A. As a result, the centrifugal force that acts on the driving scroll spiral body 33 is suitably canceled out by the driving scroll wall thickness portion 31A and the driving scroll spiral short portion 33A.

The driven scroll wall thickness portion 41A is formed in the rear surface 412 of the driven scroll end plate 41 and located close to the driven scroll spiral body 43. The driven scroll spiral short portion 43A formed in the driven scroll spiral body 43 serves as the reduced thickness portion in the driven scroll spiral body 43. As described above, the center of gravity G21 of the driven scroll wall thickness portion 41A and the center of gravity G22 of the driven scroll spiral short portion 43A are located at the positions illustrated in FIG. 3. Accordingly, a centrifugal force that acts on the driven scroll spiral body 43 when the driven scroll 40 follows the driving scroll 30 rotatably is canceled out at a position close to the driven scroll spiral body 43 by the driven scroll wall thickness portion 41A and the driven scroll spiral short portion 43A. As a result, the centrifugal force that acts on the driven scroll spiral body 43 is suitably canceled out by the driven scroll wall thickness portion 41A and the driven scroll spiral short portion 43A.

Thus, in this compressor, further dynamic imbalance of the driving scroll spiral body 33 and the driven scroll spiral body 43 is suppressed while static balance of the driving scroll spiral body 33 and the driven scroll spiral body 43 is corrected.

Therefore, the compressor of the embodiment is superior in quietness.

In addition, in this compressor, the driving scroll end plate 31, the driving scroll peripheral wall 32, the driving scroll spiral body 33, the driving scroll wall thickness portion 31A, and the driving scroll spiral short portion 33A may be formed simultaneously by casting the driving scroll main body 30A. Similarly, the driven scroll end plate 41, the driven scroll spiral body 43, the driven scroll wall thickness portion 41A, and the driven scroll spiral short portion 43A may be formed simultaneously by casting the driven scroll main body 40A. This makes it possible to reduce manufacturing costs of this compressor.

In addition, in this compressor, the recess 312*a* is formed in the rear surface 312 of the driving scroll end plate 31 such that the center of gravity G10 of the driving scroll spiral body 33 is substantially aligned with the driving axis R1, and thus, this recess 312*a* also makes it possible to adjust the static balance of the driving scroll spiral body 33.

On the other hand, the discharge reed valve 57 and the retainer 58 are fixed to the driven scroll end plate 41 by the fixing pin 59. Since the discharge reed valve 57, the retainer 58, and the fixing pin 59 are disposed so as to overlap with the driven scroll wall thickness portion 41A in the direction in which driven axis R2 extends, they are located close to the center of the spiral of the driven scroll spiral body 43 and, by extension, close to the driven axis R2, which makes the 10) center of gravity G20 of the driven scroll spiral body 43 substantially aligned with the driven axis R2. Furthermore, the discharge reed valve 57, the retainer 58, and the fixing pin 59 are made of steel, and the specific gravity of steel is larger than that of aluminum alloy, which is the material of the driven scroll main body 40A including the driven scroll end plate 41. Accordingly, it is possible to adjust the static balance of the driven scroll spiral body 43 by utilizing the weights of the discharge reed valve 57, the retainer 58, and the fixing pin 59 as well.

Although the present invention has been described based on the embodiment, the present invention is not limited to the above embodiment, and may be modified within the scope of the present invention.

For example, the compressor may have a configuration in which the driven scroll wall thickness portion 41A is not formed in the driven scroll end plate 41 and the driving scroll spiral short portion 33A is not formed in the driving scroll spiral body 33.

The compressor also may have a configuration in which the driving scroll wall thickness portion 31A is not formed in the driving scroll end plate 31 and the driven scroll spiral short portion 43A is not formed in the driven scroll spiral body 43.

In the compressor of the embodiment, the recess 312*a* is formed in the rear surface 312 of the driving scroll end plate 31. However, the present invention is not limited to this, and a protrusion that protrudes rearward may be integrally formed with the rear surface 312 and used as the "weight body" in the present invention or a member that serves as the "weight body" may be fixed to the rear surface 312.

The recess 312*a* need not be formed in the rear surface 312.

A recess similar to the recess 312*a* may be formed in the front surface 411 of the driven scroll end plate 41.

In the compressor of the embodiment, the discharge reed valve 57, the retainer 58, and the fixing pin 59 each correspond to the "weight body" in the present invention. However, the present invention is not limited to this. A bolt, or the like provided in the rear surface 312 of the driving scroll end plate 31 and the front surface 411 of the driven scroll end plate 41 may be used as the "weight body".

The compressor may have a configuration in which instead of the driven scroll end plate 41, the discharge port 48 is formed in the driving scroll end plate 31, and the discharge reed valve 57 and the retainer 58 are fixed to the driving scroll end plate 31 by the fixing pin 59.

In the compressor of the embodiment, in the driving scroll end plate 31, the first step portion 31C is formed at the boundary between the driving scroll wall thickness portion 31A and the driving scroll end plate main body portion 31B. However, the present invention is not limited to this, and the compressor may have a configuration in which the driving scroll end plate main body portion 31B is connected to the driving scroll wall thickness portion 31A with a gentle slope. This same goes for between the driven scroll wall thickness portion 41A and the driven scroll end plate main body portion 41B, between the driving scroll spiral short portion 33A and the driving scroll spiral main body portion 33B, and between the driven scroll spiral short portion 43A and the driven scroll spiral main body portion 43B.

In the compressor of the embodiment, the driven mechanism 20 is formed of the anti-rotation pins 21 and the rings 22. However, the present invention is not limited to this, and the driven mechanism 20 may be formed by a pin-ring-pin mechanism in which two pins slides on an inner peripheral surface of one free ring, a pin-and-pin mechanism in which outer peripheral surfaces of two pins slides on each other, a mechanism using Oldham's shaft coupling, or the like.

In the compressor of the embodiment, the driving scroll spiral body 33 and the driven scroll spiral body 43 are each formed so as to extend spirally clockwise; however, the present invention is not limited to this. The driving scroll spiral body 33 and the driven scroll spiral body 43 may be each formed so as to extend spirally counter-clockwise.

In the compressor of the embodiment, the driving scroll 30 is integrated with the rotor 11 by fixing the driving scroll peripheral wall 32 to the inner peripheral surface of the rotor 11. However, the present invention is not limited to this, and the compressor may have a configuration in which the driving scroll 30 is disposed apart from the rotor 11 in the direction where the driving axis R1 extends by connecting the driving scroll 30 to the rotor 11 via a driving shaft such that motive power is transmitted therebetween.

INDUSTRIAL APPLICABILITY

The present invention is applicable to an air conditioner for a vehicle, or the like.

REFERENCE SIGNS LIST

10 electric motor (driving mechanism)
20 driven mechanism
30 driving scroll
31 driving scroll end plate
31A driving scroll wall thickness portion
33 driving scroll spiral body
33A driving scroll spiral short portion
40 driven scroll
41 driven scroll end plate
41A driven scroll wall thickness portion
43 driven scroll spiral body
43A driven scroll spiral short portion
57 discharge reed valve (weight body)
58 retainer (weight body)
59 fixing pin (weight body)
60 housing
311 front surface (surface of the driving scroll end plate on which the driving scroll spiral body is formed)
312 rear surface (surface of the driving scroll end plate opposite the surface on which the driving scroll spiral body is formed)
312*a* recess (reduced thickness portion)
411 front surface (surface of the driven scroll end plate opposite the surface on which the driven scroll spiral body is formed)
412 rear surface (surface of the driven scroll end plate on which the driven scroll spiral body is formed)
G10 center of gravity of driving scroll spiral body
G20 center of gravity of driven scroll spiral body
R1 driving axis
R2 driven axis

The invention claimed is:

1. A co-rotating scroll compressor comprising:
a driving mechanism;
a driving scroll;
a driven mechanism;
a driven scroll; and
a housing;
the driving scroll being driven rotatably around a driving axis by the driving mechanism,
the driven scroll following the driving scroll rotatably around a driven axis that is eccentric to the driving scroll by the driving scroll and the driven mechanism,
the driving scroll having a driving scroll end plate that extends perpendicular to the driving axis and a driving scroll spiral body that protrudes from the driving scroll end plate toward the driven scroll and is formed in a spiral shape,
the driven scroll having a driven scroll end plate that extends perpendicular to the driven axis and a driven scroll spiral body that protrudes from the driven scroll end plate toward the driving scroll and is formed in a spiral shape, and
the driving scroll and the driven scroll forming a compression chamber with the driving scroll spiral body and the driven scroll spiral body facing each other, the compression chamber changing its volume by the rotational driving of the driving scroll and the rotational following of the driven scroll, wherein
a driving scroll wall thickness portion is formed on a surface of the driving scroll end plate on which the driving scroll spiral body is formed or a driving scroll spiral short portion is formed in the driving scroll spiral body, the driving scroll wall thickness portion protruding toward the driven scroll end plate such that a center of gravity of the driving scroll spiral body is made at least approximately aligned with the driving axis, the driving scroll spiral short portion being shorter than a portion having the longest length in the driving scroll spiral body that extends toward the driven scroll end plate,
in a case where the driving scroll wall thickness portion is formed, a driven scroll spiral short portion is formed in the driven scroll spiral body, the driven scroll spiral short portion being shorter than a portion having the longest length in the driven scroll spiral body that extends toward the driving scroll end plate such that the driven scroll spiral short portion allows the driven scroll spiral body to avoid interference with the driving scroll wall thickness portion,
in a case where the driving scroll spiral short portion is formed, a driven scroll wall thickness portion is formed on a surface of the driven scroll end plate on which the driven scroll spiral body is formed, the driven scroll wall thickness portion protruding toward the driving scroll spiral short portion, and a recess is formed in at least one of a surface of the driving scroll end plate opposite the surface on which the driving scroll spiral body is formed or a surface of the driven scroll end plate opposite a surface on which the driven scroll spiral body is formed so that the recess is overlapped with an imaginary center of gravity, wherein the imaginary center of gravity is a theoretical center of gravity of the driving scroll or the driven scroll with the scroll wall thickness portion not formed in a respective end plate of the driving scroll or the driven scroll and the spiral short portion not formed in a respective spiral body of the driving scroll or the driven scroll.

2. A co-rotating scroll compressor comprising:

a driving mechanism;

a driving scroll;

a driven mechanism;

a driven scroll; and a housing;

the driving scroll being driven rotatably around a driving axis by the driving mechanism, the driven scroll following the driving scroll rotatably around a driven axis that is eccentric to the driving scroll by the driving scroll and the driven mechanism, the driving scroll having a driving scroll end plate that extends perpendicular to the driving axis and a driving scroll spiral body that protrudes from the driving scroll end plate toward the driven scroll and is formed in a spiral shape, the driven scroll having a driven scroll end plate that extends perpendicular to the driven axis and a driven scroll spiral body that protrudes from the driven scroll end plate toward the driving scroll and is formed in a spiral shape, and the driving scroll and the driven scroll forming a compression chamber with the driving scroll spiral body and the driven scroll spiral body facing each other, the compression chamber changing its volume by the rotational driving of the driving scroll and the rotational following of the driven scroll, wherein a driven scroll wall thickness portion is formed on a surface of the driven scroll end plate on which the driven scroll spiral body is formed or a driven scroll spiral short portion is formed in the driven scroll spiral body, the driven scroll wall thickness portion protruding toward the driving scroll end plate such that a center of gravity of the driven scroll spiral body is made at least approximately aligned with the driven axis, the driven scroll spiral short portion being shorter than a portion having the longest length in the driven scroll spiral body that extends toward the driving scroll end plate, in a case where the driven scroll wall thickness portion is formed, a driving scroll spiral short portion is formed in the driving scroll spiral body, the driving scroll spiral short portion being shorter than a portion having the longest length in the driving scroll spiral body that extends toward the driven scroll end plate such that the driving scroll spiral short portion allows the driving scroll spiral body to avoid interference with the driven scroll wall thickness portion, in a case where the driven scroll spiral short portion is formed, a driving scroll wall thickness portion is formed on a surface of the driving scroll end plate on which the driving scroll spiral body is formed, the driving scroll wall thickness portion protruding toward the driven scroll spiral short portion, and a recess is formed in at least one of a surface of the driving scroll end plate opposite a surface on which the driving scroll spiral body is formed or a surface of the driven scroll end plate opposite the surface on which the driven scroll spiral body is formed so that the recess is overlapped with an imaginary center of gravity, wherein the imaginary center of gravity is a theoretical center of gravity of the driving scroll or the driven scroll with the scroll wall thickness portion not formed in a respective end plate of the driving scroll or the driven scroll and the spiral short portion not formed in a respective spiral body of the driving scroll or the driven scroll.

3. A co-rotating scroll compressor comprising:

a driving mechanism;

a driving scroll;

a driven mechanism;

a driven scroll; and a housing;

the driving scroll being driven rotatably around a driving axis by the driving mechanism, the driven scroll following the driving scroll rotatably around a driven axis that is eccentric to the driving scroll by the driving scroll and the driven mechanism, the driving scroll having a driving scroll end plate that extends perpendicular to the driving axis and a driving scroll spiral body that protrudes from the driving scroll end plate toward the driven scroll and is formed in a spiral shape, the driven scroll having a driven scroll end plate that extends perpendicular to the driven axis and a driven scroll spiral body that protrudes from the driven scroll end plate toward the driving scroll and is formed in a spiral shape, and the driving scroll and the driven scroll forming a compression chamber with the driving scroll spiral body and the driven scroll spiral body facing each other, the compression chamber changing its volume by the rotational driving of the driving scroll and the rotational following of the driven scroll, wherein a driving scroll wall thickness portion protruding toward the driven scroll spiral body is formed in the driving scroll end plate, a driven scroll wall thickness portion protruding toward the driving scroll spiral body is formed in the driven scroll end plate, a driving scroll spiral short portion is formed in the driving scroll spiral body, the driving scroll spiral short portion being shorter than a portion having the longest length in the driving scroll spiral body that extends toward the driven scroll end plate such that the driving scroll spiral short portion allows the driving scroll spiral body to avoid interference with the driven scroll wall thickness portion, a driven scroll spiral short portion is formed in the driven scroll spiral body, the driven scroll spiral short portion being shorter than a portion having the longest length in the driven scroll spiral body that extends toward driving scroll end plate such that the driven scroll spiral short portion allows the driven scroll spiral body to avoid interference with the driving scroll wall thickness portion, the driving scroll wall thickness portion and the driving scroll spiral short portion are disposed such that a center of gravity of the driving scroll spiral body is made at least approximately aligned with the driving axis, the driven scroll wall thickness portion and the driven scroll spiral short portion are disposed such that a center of gravity of the driven scroll spiral body is made at least approximately aligned with the driven axis, and a recess is formed in at least one of a surface of the driving scroll end plate opposite a surface on which the driving scroll spiral body is formed or a surface of the driven scroll end plate opposite a surface on which the driven scroll spiral body is formed so that the recess is overlapped with an imaginary center of gravity, wherein the imaginary center of gravity is a theoretical center of gravity of the driving scroll or the driven scroll with the scroll wall thickness portion not formed in a respective end plate of the driving scroll or the driven scroll and the spiral short portion not formed in a respective spiral body of the driving scroll or the driven scroll.

4. The co-rotating scroll compressor according to claim 1, wherein a weight body is provided such that the center of gravity of the driving scroll spiral body is made at least approximately aligned with the driving axis, on the surface of the driving scroll end plate opposite the surface on which the driving scroll spiral body is formed.

5. The co-rotating scroll compressor according to claim 1, wherein a weight body is provided such that the center of gravity of the driven scroll spiral body is made at least approximately aligned with the driven axis, on the surface of the driven scroll end plate opposite the surface on which the driven scroll spiral body is formed.

6. The co-rotating scroll compressor according to claim 2, wherein a weight body is provided such that the center of gravity of the driving scroll spiral body is made at least approximately aligned with the driving axis, on the surface of the driving scroll end plate opposite the surface on which the driving scroll spiral body is formed.

7. The co-rotating scroll compressor according to claim 2, wherein a weight body is provided such that the center of gravity of the driven scroll spiral body is made at least approximately aligned with the driven axis, on the surface of the driven scroll end plate opposite the surface on which the driven scroll spiral body is formed.

8. The co-rotating scroll compressor according to claim 3, wherein a weight body is provided such that the center of gravity of the driving scroll spiral body is made at least approximately aligned with the driving axis, on the surface of the driving scroll end plate opposite the surface on which the driving scroll spiral body is formed.

9. The co-rotating scroll compressor according to claim 3, wherein a weight body is provided such that the center of gravity of the driven scroll spiral body is made at least approximately aligned with the driven axis, on the surface of the driven scroll end plate opposite the surface on which the driven scroll spiral body is formed.

* * * * *